US007972110B2

(12) United States Patent
Seki et al.

(10) Patent No.: US 7,972,110 B2
(45) Date of Patent: Jul. 5, 2011

(54) CENTRIFUGAL BLOWER

(75) Inventors: Hideki Seki, Nagoya (JP); Masaharu Sakai, Obu (JP); Toshinori Ochiai, Obu (JP); Yasushi Mitsuishi, Anjo (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 896 days.

(21) Appl. No.: 11/714,521

(22) Filed: Mar. 6, 2007

(65) Prior Publication Data

US 2007/0212218 A1 Sep. 13, 2007

(30) Foreign Application Priority Data

Mar. 7, 2006 (JP) ..... 2006-061089

(51) Int. Cl.
*F04D 29/42* (2006.01)

(52) U.S. Cl. ..... 415/204; 415/206

(58) Field of Classification Search ..... 415/119, 415/203, 204, 205, 206
See application file for complete search history.

(56) References Cited

U.S. PATENT DOCUMENTS

| | | | | |
|---|---|---|---|---|
| 340,120 | A * | 4/1886 | Hussey | 415/205 |
| 5,601,400 | A * | 2/1997 | Kondo et al. | 415/119 |
| 5,839,879 | A * | 11/1998 | Kameoka et al. | 415/206 |
| 6,162,016 | A * | 12/2000 | Humbad | 415/204 |
| 6,821,088 | B2 * | 11/2004 | Sakai et al. | 415/204 |
| 7,481,616 | B2 * | 1/2009 | Tamagawa et al. | 415/176 |
| 7,549,842 | B2 * | 6/2009 | Hanson et al. | 415/204 |
| 2003/0012649 | A1 * | 1/2003 | Sakai et al. | 415/206 |

FOREIGN PATENT DOCUMENTS

| | | |
|---|---|---|
| JP | 54-97805 | 12/1952 |
| JP | 10-252695 | 9/1998 |
| JP | 2001-289198 | 10/2001 |
| JP | 2002-202098 | 7/2002 |
| JP | 2005-083244 | 3/2005 |
| JP | 2006-322442 | 11/2006 |

OTHER PUBLICATIONS

Office action dated Apr. 25, 2008 in Chinese Application No. 200710085507.1 with English translation.
Office action dated Mar. 1, 2011 in corresponding Japanese Application No. 2006-061089.

* cited by examiner

*Primary Examiner* — Edward Look
*Assistant Examiner* — Ryan H Ellis
(74) *Attorney, Agent, or Firm* — Harness, Dickey & Pierce, PLC

(57) ABSTRACT

A centrifugal blower having a fan including a blade. A scroll casing houses the fan and has a first axial wall portion, a second axial wall portion, and a side wall extending between the first and second axial wall portions. The scroll casing includes a suction port in the first axial wall portion. The scroll casing also defines a scroll start portion and a scroll finish portion. The scroll casing has a scroll radius measured transverse to the rotation axis that changes from the scroll start portion to the scroll finish portion. Also, a maximum radius of the scroll radius is closer to the second axial wall portion than the first axial wall portion.

20 Claims, 14 Drawing Sheets

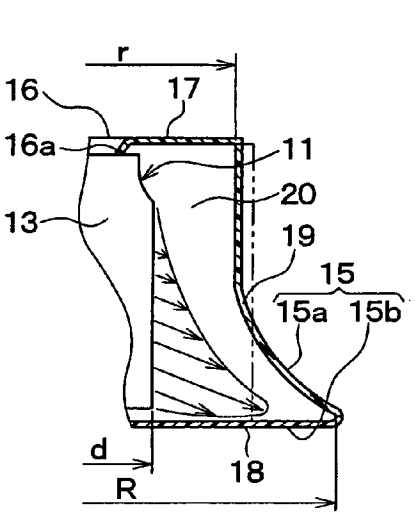
FIG. 3A
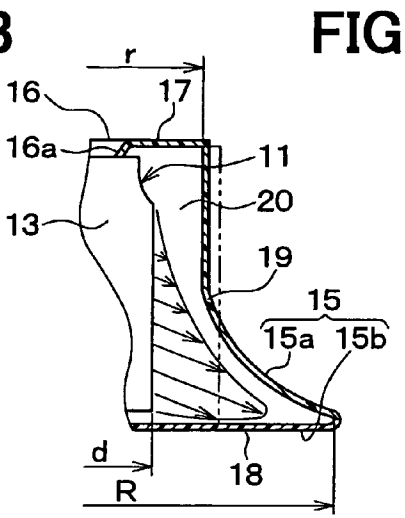
FIG. 3B
FIG. 3C
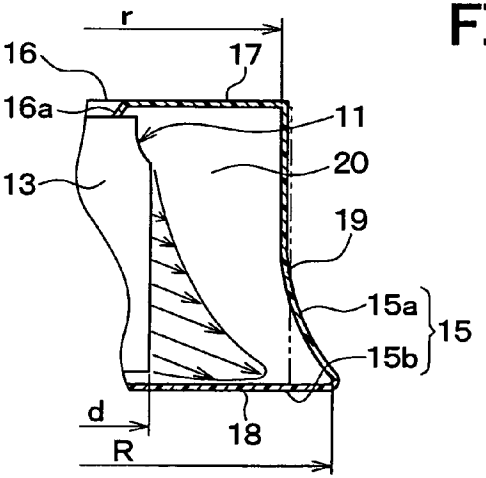
FIG. 3D
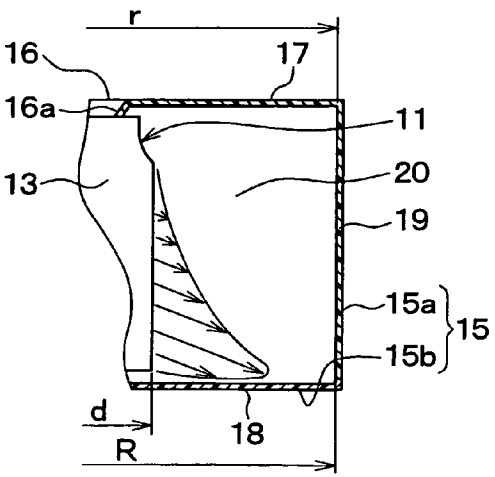
FIG. 3E

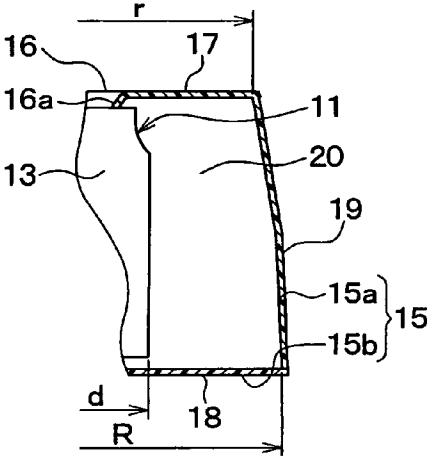
FIG. 11A
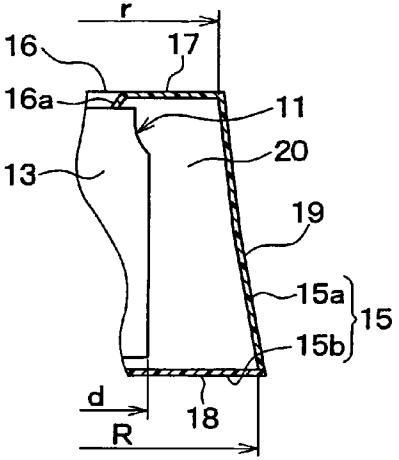
FIG. 11B
FIG. 11C
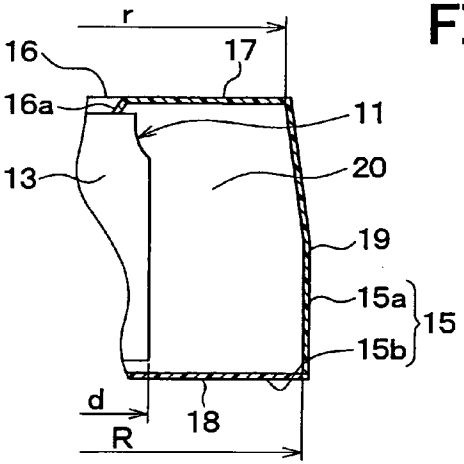
FIG. 11D
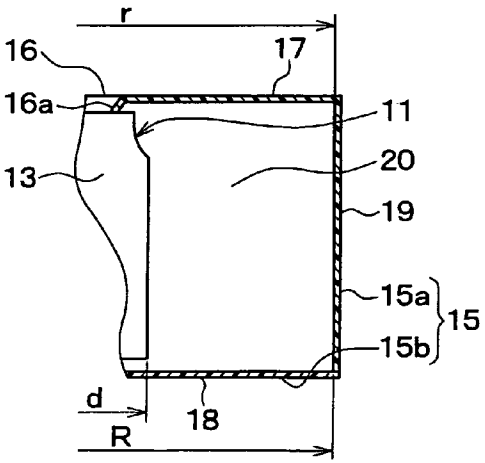
FIG. 11E

CENTRIFUGAL BLOWER

CROSS REFERENCE TO RELATED APPLICATION

The following is based on and claims priority to Japanese Patent Application No. 2006-61089, filed Mar. 7, 2006, which is hereby incorporated by reference in its entirety.

FIELD

The following disclosure relates to a centrifugal blower equipped with a centrifugal fan that rotates around a rotation axis and, more particularly, to a centrifugal fan for a blower of an air conditioner.

BACKGROUND

In many conventional centrifugal blowers, a centrifugal multi-blade fan is provided in a central portion of a scroll casing. The scroll casing includes an air passage in which air blows radially outward due to rotational motion of the centrifugal multi-blade fan. An air-blowing exit is provided at a scroll finish side of the scroll casing and air blows through the exit and out of the blower.

In addition, in many conventional centrifugal blowers, a radius of the scroll casing (scroll radius) increases from a scroll start side (nose portion) toward a scroll finish side of the scroll casing. Thereby, a width of the air passage (dimension of the air passage in the radial direction of the centrifugal multi-blade fan) increases from the scroll start toward the scroll finish side of the scroll casing. Since a cross sectional area of the air passage increases from the scroll start side toward the scroll finish side of the scroll casing, occurrence of stagnation or contraction of air flow in the air passage is reduced. Also, it is possible to increase a flow amount of the air from the scroll start side toward the scroll finish side of the scroll casing. JP-2002-339899A discloses one example of this type of centrifugal blower.

However, these conventional centrifugal blowers can create undesirable noise. More specifically, since the width of the air passage is abruptly reduced from the scroll finish portion toward the scroll start portion of the scroll casing, static pressure between blades at the scroll start side becomes abruptly higher as compared to a static pressure between blades at the scroll finish side (refer to a comparative example 1 in FIG. 8 to be described in greater detail below). Further, noise can be caused by fluctuations of the static pressure between the blades.

In response to this problem, the scroll radius can be enlarged at the scroll start portion to increase the width of the air passage at the scroll start portion, thus avoiding an abrupt reduction in the width of the air passage from the scroll finish portion toward the scroll start portion of the scroll casing. However, simply enlarging the width of the air passage at the scroll start portion results in an expansion of a communicating area between the scroll finish portion and the scroll start portion. As a result, air re-circulation can increase from the scroll finish side (air-blowing exit) portion toward the scroll start (hereinafter refer to this air as recirculation flow) to reduce a blowing pressure, thereby reducing blowing properties. In addition, an increase of the recirculation flow leads to an increase in noise caused by interaction of the recirculation flow and the air blown from the centrifugal multi-blade fan.

In view of the above, there exists a need for a centrifugal blower which overcomes the above mentioned problems in the conventional art.

SUMMARY

A centrifugal blower is disclosed that includes a fan including a blade. The fan rotates around a rotation axis. A scroll casing is also includes that houses the fan. The scroll casing has a first axial wall portion, a second axial wall portion, and a side wall extending between the first and second axial wall portions. The scroll casing includes a suction port in the first axial wall portion. Also, the scroll casing defines a scroll start portion and a scroll finish portion such that the fan sucks a fluid through the suction port and pushes the fluid from the scroll start portion and out of the scroll casing from the scroll finish portion. The scroll casing has a scroll radius measured transverse to the rotation axis that changes from the scroll start portion to the scroll finish portion. Also, a maximum radius of the scroll radius is closer to the second axial wall portion than the first axial wall portion.

BRIEF DESCRIPTION OF THE DRAWINGS

Other objects, features, and advantages of the present disclosure will become more apparent from the following detailed description made with reference to the accompanying drawings, in which like parts are designated by like reference numbers and in which:

FIG. 3A is a cross sectional view of the blower taken along line A-A of FIG. 2;

FIG. 3B is a cross sectional view of the blower taken along line B-B of FIG. 2;

FIG. 3C is a cross sectional view of the blower taken along line C-C of FIG. 2;

FIG. 3D is a cross sectional view of the blower taken along line D-D of FIG. 2;

FIG. 3E is a cross sectional view of the blower taken along line E-E of FIG. 2;

FIG. 11A is a cross section view of the blower taken along line F-F of FIG. 10;

FIG. 11B is a cross section view of the blower taken along line G-G of FIG. 10;

FIG. 11C is a cross section view of the blower taken along line H-H of FIG. 10;

FIG. 11D is a cross section view of the blower taken along line I-I of FIG. 10;

FIG. 11E is a cross section view of the blower taken along line J-J of FIG. 10;

DETAILED DESCRIPTION

First Embodiment

Figure 1:
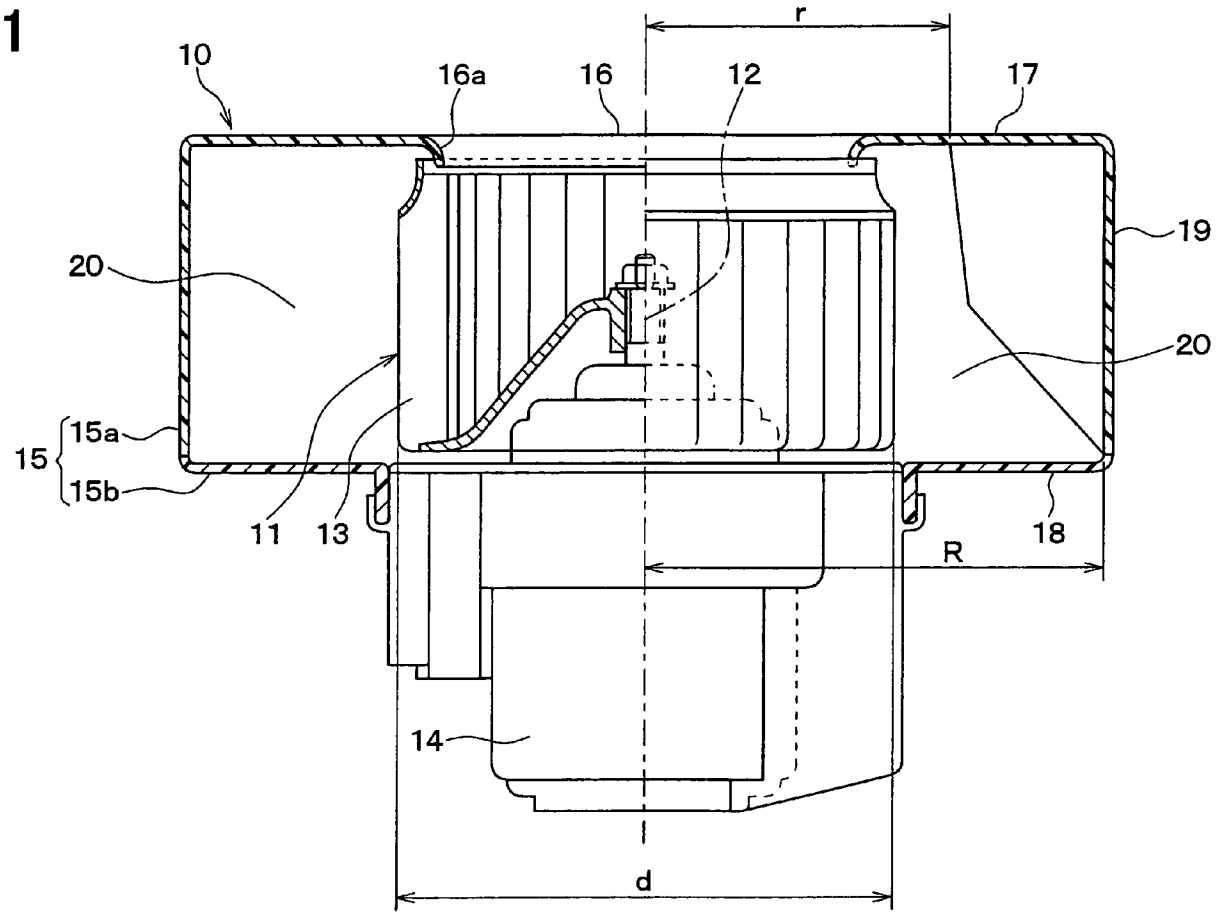
FIG. 1 is a cross sectional view of a first embodiment of a blower.

Referring initially to FIGS. 1-9, a centrifugal blower 10 is shown. The blower 10 includes a centrifugal multi-blade fan 11 (a blowing means) which includes a plurality of blades 13 arranged around a rotation axis 12. The fan 11 moves air from a radial inner side (the side adjacent the rotation axis 12) toward a radial outer side transverse to the rotation axis 12. The fan 11 is housed within a scroll casing 15 (hereinafter referred to as "scroll").

Figure 2:
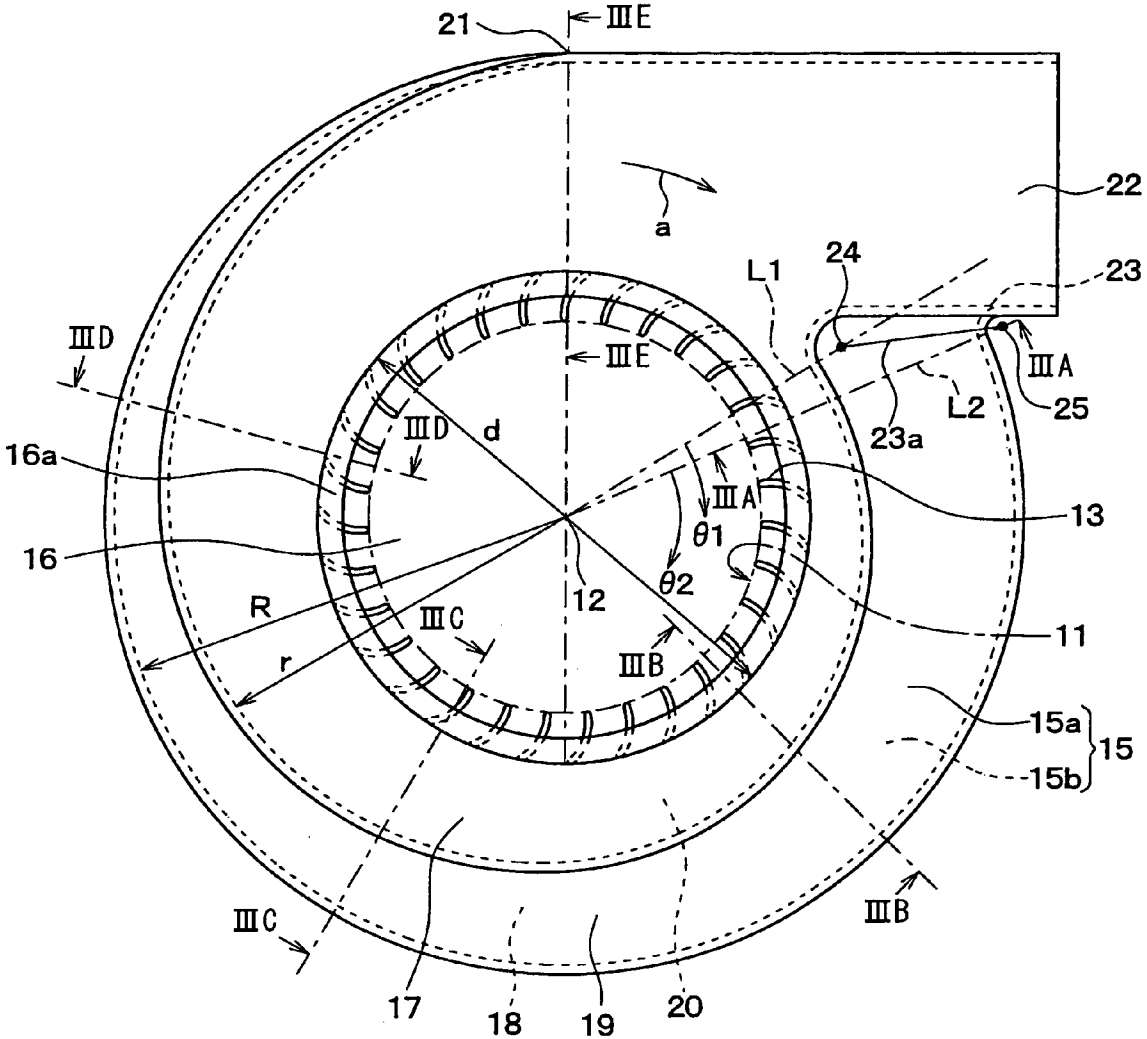
FIG. 2 is a top view of the blower of FIG. 1.

The blower 10 also includes an electric motor 14 (drive means) which rotates and drives the fan 11 in the direction of arrow "a" shown in FIG. 2. The motor 14 is fixed to the scroll 15.

The scroll 15 is formed in a spiral shape in such a manner that the fan 11 is positioned in the central portion. A suction port 16 for introducing air is formed in the scroll 15 at an axial end side opposite the motor 14. A bell mouth 16*a* is included in the scroll 15 around the periphery of the suction port 16 for smoothly introducing the sucked air to the fan 11.

On one axial end, the scroll 15 includes a suction port-side wall portion 17 extending from an outer peripheral edge portion of the bell mouth 16*a* to the radial outer side of the fan 11 and has a spiral and planar shape. On the opposite axial end, the scroll 15 includes a motor-side wall portion 18 extending from an outer periphery of the motor 14 to the radial outer side of the fan 11 and has an annular and planar shape. Furthermore, the scroll 15 includes a side wall 19 that extends between and is coupled to the outer peripheries of the wall portions 17, 18. It is noted that the suction port-side wall portion 17 corresponds to the first axial wall portion and the motor-side wall portion 18 corresponds to the second axial wall portion in this embodiment.

The scroll 15 is divided into two division elements 15*a*, 15*b* at the side of the suction port 16 and at the side of the motor 14 and is structured by coupling the two division elements 15*a*, 15*b* with fastening means such as a screw or a clip.

An air passage 20 through which fluid (e.g., air) flows is defined within the scroll 15. Specifically, air sucked into the port 16 by the fan 11 flows through the air passage 20 and out of the scroll 15. The air passage 20 is defined between the suction port-side wall portion 17, the motor-side wall portion 18, the side wall 19 and the radial outer side edge portion of the fan 11. Thus, the fan 11 and the scroll 15 cooperate to define the air-passage 20 within the scroll 15.

An air-blowing exit 22 is included at a downstream air-flowing side of the air passage 20. More specifically, the air-blowing exit 22 is defined at the side of the scroll finish portion 21 of the scroll 15 such that air flowing in the air passage 20 flows out of the blower 10.

Next, the configuration of the scroll 15 will be explained in more detail. As shown in FIG. 2, a nose portion 23 of the scroll 15 has a curvature radius which decreases from the axial end of the scroll 15 adjacent the port 16 (hereinafter referred to as the suction port-side scroll start portion) to the opposite axial end of the scroll 15 adjacent the motor 14 (hereinafter referred to as the motor-side scroll start portion). As a result, a line 23*a* connecting a curvature center 24 of the suction port-side scroll start portion with a curvature center 25 of the motor-side scroll start portion is inclined relative to the radial direction.

The scroll 15 includes a scroll radius dimension, which is a dimension measured transversely from the axis 12 to the side wall 19. The scroll radius changes from the motor-side scroll start portion 25 to the scroll finish portion 21.

At the scroll start portion 25 shown in FIG. 3A, for instance, the scroll radius is at a minimum radius r adjacent the port-side side wall portion 17. The scroll radius is at a maximum radius R adjacent the motor-side wall portion 18. In the first embodiment, the maximum radius R is approximately equal to the diameter d of the fan 11. As a result, the cross sectional area of the air passage 20 is larger adjacent the motor-side wall portion 18 as compared to the cross sectional area adjacent the port-side wall portion 17. In other words, the scroll radius is at a maximum radium radius R adjacent the motor-side wall portion 18.

In FIG. 3A, arrows inside the air passage 20 schematically show a flow velocity distribution of the air blown from the fan 11. As shown, the fan 11 blows the air sucked from the suction port 16 transversely away from the fan 11, and the air flow velocity distribution is greater near the motor-side wall portion 18 as compared to the port-side wall portion 17. Accordingly, the he cross sectional area of the air passage 20 is larger adjacent the motor-side wall portion 18 as compared to the cross sectional area adjacent the port-side wall portion 17.

A broken line in FIG. 3A shows the corresponding cross section of an air passage in the comparative example 1 blower. This comparative example 1 corresponds to the blower of JP-2002-339899A. In the first embodiment, the scroll radius R adjacent the motor 14 is greater than that in the comparative example 1. Also, the scroll radius r adjacent the port 16 is smaller than that in the comparative example 1.

Figure 4:
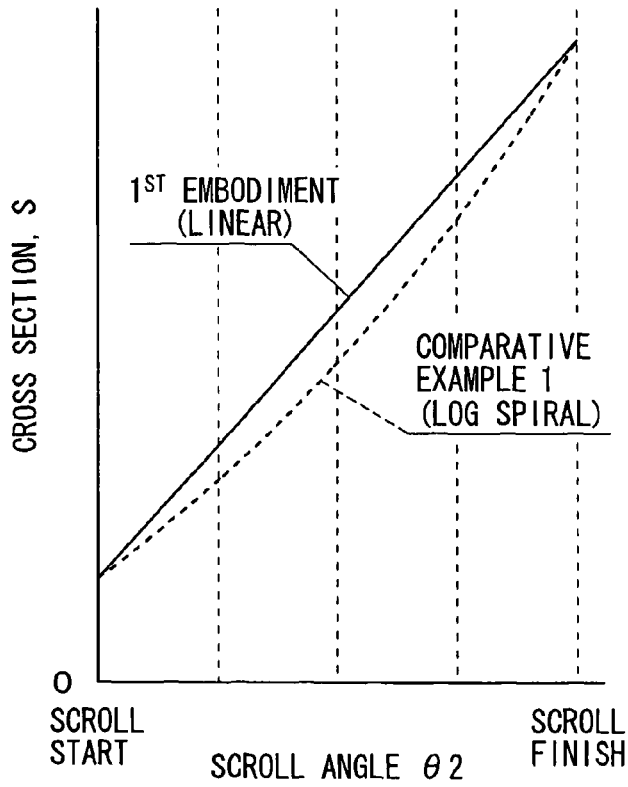
FIG. 4 is a graph showing a relationship of a motor-side scroll angle and a cross sectional area of the first embodiment and that of a comparative example 1.

As such, at the motor-side scroll start portion 25, a cross sectional area S of the air passage 20 is approximately equal to the corresponding cross section area of the comparative example 1 as shown in FIG. 4.

As shown in FIGS. 3A to 3E, a cross sectional configuration of the side wall 19 changes from the scroll start portion 25 to the scroll finish portion 21. Specifically, at the scroll start portion 25, the side wall 19 is curved radially outward adjacent the motor 14, and the radius of curvature decreases from the scroll start portion 25 to the scroll finish portion 21.

Eventually, the curvature is sufficiently decreased such that, at the scroll finish portion 21 shown in FIG. 3E, the side wall 19 is approximately parallel to the rotation axis 12.

More specifically, the minimum radius r increases from the scroll start portion 23 to the scroll finish portion 21. In this embodiment, the minimum radius r changes to be logarithmic spiral, that is, in the form of:

$$r=r0*\exp(\theta 1*\tan(\alpha)).$$

Here, "suction port-side scroll angle θ1", as shown in FIG. 2, means an angle measured in the fan rotational direction a from a reference line L1 connecting the suction port-side scroll start portion 24 with the rotational center of the fan 11. "r0" is the minimum radius on the reference line L1. "α" is an expanding angle, which is from 3 to 5 degrees in the first embodiment.

In the first embodiment, the minimum radius r increases to be in a logarithmic spiral shape. However, the minimum radius r may increase to be linear in proportion to the suction port-side scroll angle θ1 and further may increase sequentially.

On the other hand, the maximum radius R remains approximately constant from motor-side scroll start portion 25 to the scroll finish portion 21. In other words, the maximum radius R is constant independent of the motor-side scroll angle θ2. Here, "suction port-side scroll angle θ2", as shown in FIG. 2, means an angle measured in the fan rotational direction a from a reference line L2 connecting the motor-side scroll start portion 25 with the rotational center of the fan 11.

In addition, since the minimum radius r is approximately equal to the maximum radius R at the scroll finish portion 21, the cross section of the air passage 20 is substantially rectangular as shown in FIG. 3E.

In FIGS. 3B to 3E, arrows inside the air passage 20 schematically show a flow velocity distribution of the air blown from the fan 11 in the same way as in FIG. 3A. As shown, flow velocity distribution is greater near the motor-side wall portion 18. Accordingly, for much of the air passage 20, the cross sectional area near the motor-side wall portion 18 is larger than the port-side wall portion 17.

The broken lines in FIGS. 3A to 3D show the corresponding cross section configuration of the air passage 20 for the comparative example 1. At the scroll start portion 25 and the scroll finish portion 21, the cross sectional area for the first embodiment is approximately the same as the comparative example 1 as shown in FIG. 4. However, for the region between the scroll start and finish portions 25, 21, the cross sectional area of the first embodiment is greater than the comparative example 1 as shown in FIG. 4.

Also, as shown in FIG. 4, the cross sectional area increases linearly from the scroll start portion 25 to the scroll finish portion 21. In contrast, in the comparative example 1, the cross sectional area S changes to be logarithmic spiral, that is, in the form of $S=S0\cdot\exp(\theta 2\cdot\tan(\alpha))$. In this embodiment, "S0" is the cross section area on the reference line L. "α" is an expanding angle, which is from 3 to 5 degrees.

Next, an operation of the first embodiment with such structure will be described. When the electric motor 14 is energized to rotate and drive the fan 11 in the arrow a direction in FIG. 2, the fan 11 blows the air sucked from the suction port 16 at the rotation axis 12 to the radial outer side of the fan 11. The air blown from the fan 11 flows in the air passage 20 from the scroll start portion 25 toward the scroll finish portion 21 to be blown from the air-blowing exit 22 and then outside of the blower 10.

As seen in FIG. 3E, in the scroll finish portion 21, the width of the air passage 20 (dimension of the air passage 20 in the radial direction) perpendicular to the rotation axis 12 is broadened over the entire region from the suction port 16-side end portion to the motor 14-side end portion. On the other hand, as seen in FIG. 3A, at the scroll start portion 25, the width of the air passage 20 adjacent the suction port 16 is narrow, but the width of the air passage 20 adjacent the motor 14 is broader according to the flow velocity distribution represented by the arrows.

In other words, adjacent the motor 14, the width of the air passage 20 at the scroll start portion 25 is substantially the same in dimension as the width of the air passage in the scroll finish portion 21. Therefore, it is possible to decrease static pressure between the blades 13 in the motor-side scroll start portion 25 to thereby restrict the fluctuation of the static pressure between the blades. As a result, it is possible to reduce noise during operation.

In comparison, in the comparative example 1 (broken line in FIG. 3A), the width of the air passage adjacent the motor 14 is significantly more narrow than the width of the air passage 20. In other words, in the comparative example 1, the width of the air passage in the side of the motor 14 is abruptly reduced between the scroll finish portion 21 and the motor-side scroll start portion 25. Therefore, static pressure between the blades increases in the motor-side scroll start portion 25 to increase the fluctuation of the static pressure between the blades, and noise is more likely to increase.

In the first embodiment, the width of the air passage 20 adjacent the port-side wall portion 17 is narrower than that in the comparative example 1. However, the flow velocity is low in this region. Therefore, the static pressure between the blades of the fan 11 is unlikely to increase.

Since in the first embodiment, the cross section area S of the air passage 20 increases from the scroll start portion 25 to the scroll finish portion 21, a flow amount of the air flowing in the air passage 20 blown from the fan 11 can be increased. Therefore, even if the width of the air passage 20 adjacent the motor-side wall portion 18 is broadened, it is possible to maintain sufficient blowing properties, ensuring a predetermined blowing capability.

Figure 5:
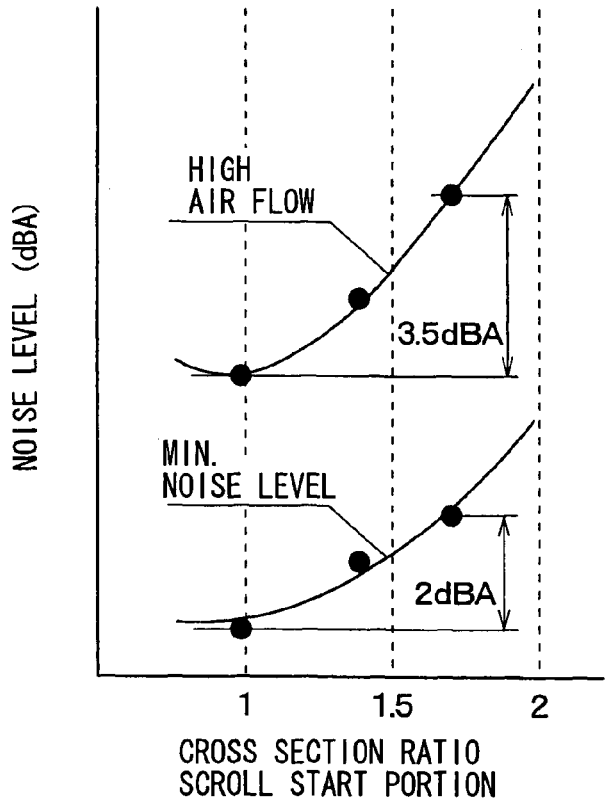
FIG. 5 is a graph showing a relationship of a cross sectional area of an air passage at a motor-side scroll start portion and a specific noise level.

In addition, since the cross section area S of the air passage 20 at the scroll start portion 25 in the first embodiment is the same as the corresponding cross section area in the comparative example 1, it is possible to further reduce the noise as shown in FIG. 5. FIG. 5 is a graph showing a relation between a cross sectional area of the air passage in the scroll start portion 25 and a specific noise level obtained by measuring the minimum specific noise level and a specific noise level at the time of a high flow amount with a blower in the comparative example 1 and a blower in which a cross section area of an air passage in the scroll start portion changes relative to the comparative example 1. The horizontal axis in FIG. 5 is a cross section area ratio obtained by setting the cross section area of the air passage in the scroll start portion of the comparative example 1 to "1".

As seen in FIG. 5, when the cross sectional area of the air passage in the scroll start portion is the same as the corresponding cross section area of the comparative example 1, the minimum specific noise level and the specific noise level at the time of the high flow amount are substantially at a minimum.

This is because, when the cross sectional area of the air passage in the scroll start portion 25 is smaller than the corresponding cross sectional area of the comparative example 1, the cross sectional area of the air passage from the scroll finish portion to the scroll start portion is reduced to increase the fluctuation of the static pressure between the blades, thereby increasing the specific noise level.

On the other hand, when the cross sectional area of the air passage in the scroll start portion 25 is greater than the corresponding cross section area of the comparative example 1, the communicating area between the scroll finish portion and the scroll start portion is increased to thereby increase the flow interaction between the recirculation flow through the nose portion from the scroll finish portion and the suction air, thereby increasing the specific noise level.

Figure 6:
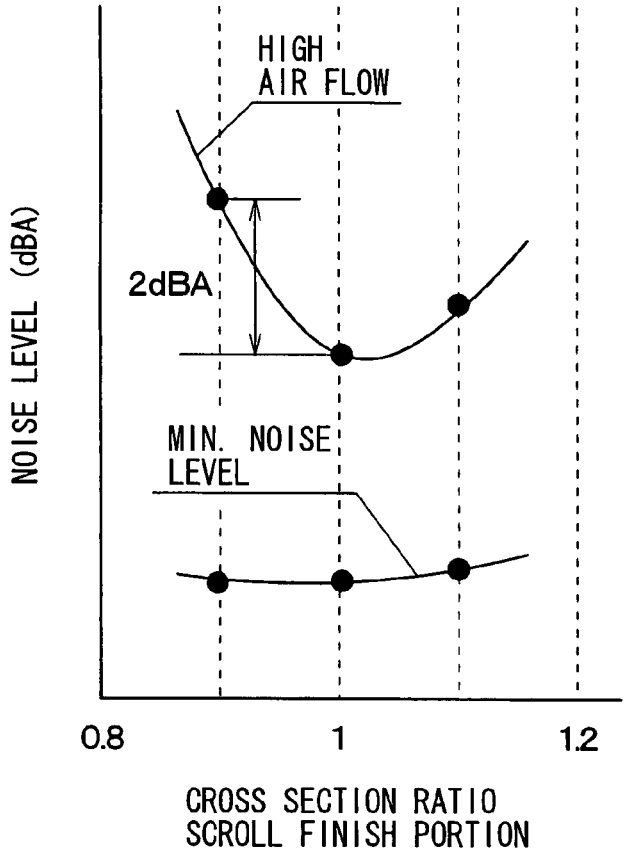
FIG. 6 is a graph showing a relationship of a cross sectional area of an air passage at a motor-side scroll finish portion and a specific noise level.

In addition, since the cross sectional area S of the air passage 20 in the scroll finish portion 21 is the same as the corresponding cross section area in the comparative example 1, it is possible to further reduce a noise level as shown in FIG. 6. FIG. 6 is a graph showing a relation between a cross sectional area of an air passage in the scroll finish portion and a specific noise level obtained by measuring the minimum specific noise level and the specific noise level at the time of a high flow amount with respect to the blower in the comparative example 1 and the blower in which a cross section area of the air passage in the scroll finish portion is changed to that of the comparative example 1. The horizontal axis in FIG. 6 is a cross sectional area ratio by setting the cross section area of the air passage in the scroll finish portion of the comparative example 1 to "1".

As seen in FIG. 6, when the cross sectional area of the air passage in the scroll finish portion is the same as the corresponding cross section area of the comparative example 1, the minimum specific noise level and the specific noise level at the time of the high flow amount are substantially at a minimum. This is because, when the cross sectional area of the air passage in the scroll finish portion is set to be smaller than the corresponding cross section area of the comparative example 1, the air flow is reduced in the scroll finish portion to generate a vortex, thereby increasing the specific noise level. On the other hand, when the cross section area of the air passage in the scroll finish portion is set to be greater than the corresponding cross section area of the comparative example 1, stagnation or reverse flow of the air flow is generated in the scroll finish portion to make the air flow be unstable, thereby increasing the specific noise level.

Figure 7:
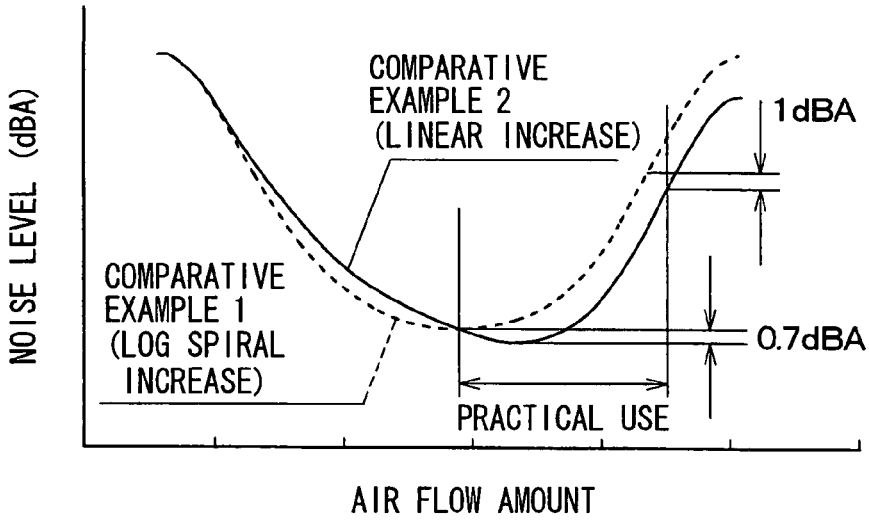
FIG. 7 is a graph showing a test result which has measured specific noise levels in the comparative example 1 and the comparative example 2.

Further, the cross sectional area of the air passage 20 increases linearly from the motor-side scroll start portion 25 toward the scroll finish portion 21 and therefore, it is possible to further reduce the noise level as shown in FIG. 7. FIG. 7 is a graph showing a specific noise level with respect to the comparative example 1 and a blower (comparative example 2) in which a cross section area changes linearly relative to the comparative example 1. In FIG. 7, a solid line shows a specific noise level in the comparative example 2 and a broken line shows a specific noise level in the comparative example 1.

As shown in FIG. 7, in a range where a flow amount is in a practical use region, the specific noise level in the comparative example 2 in which the cross sectional area increases linearly is lower than the specific noise level in the comparative example 1 in which the cross sectional area increases according to a logarithmic spiral. This is because when the cross sectional area increases linearly in the flow amount range in a practical use region, it is possible to restrict occurrence of stagnation or contraction in the air flow in the air passage, as compared to a case where the cross section area increases to be logarithmic spiral.

Figure 8:
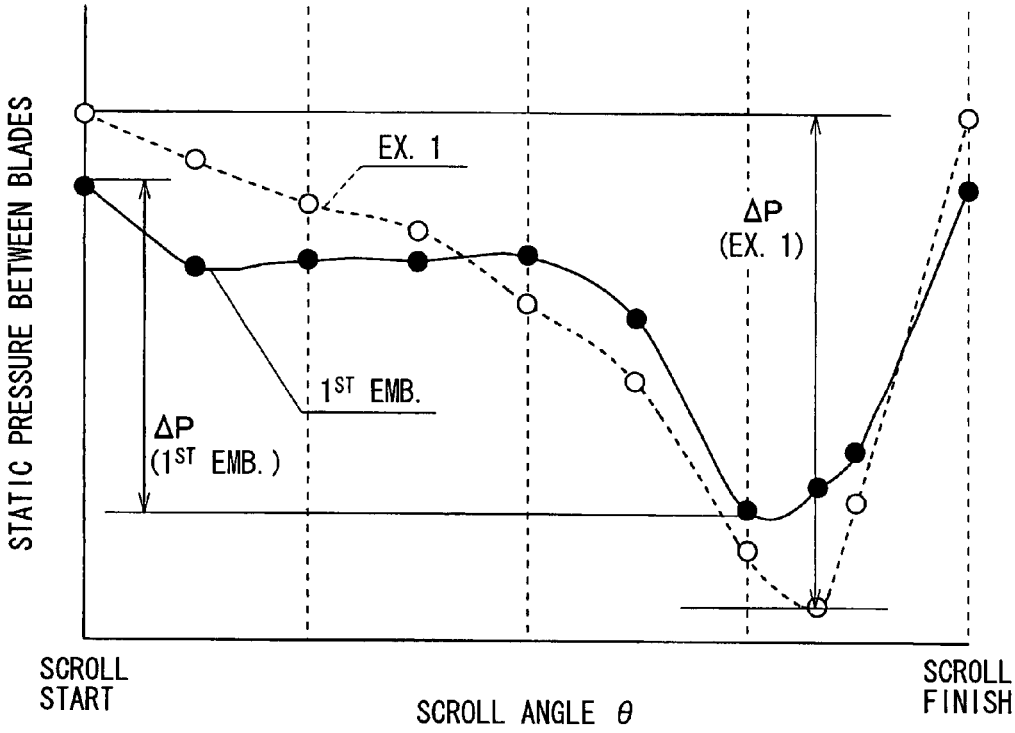
FIG. 8 is a graph comparing a fluctuation of static pressure between blades in the first embodiment and that of the comparative example 1.

FIG. 8 is a graph obtained by comparing a fluctuation (solid line) of a static pressure between blades in the first embodiment with a fluctuation (broken line) of a static pressure between blades in the comparative example 1. FIG. 8 is a graph produced by 3D-modeling and CFD analysis of the blower 10 in the first embodiment and the blower in the comparative example 1 and shows a relation between a scroll angle θ and a static pressure between blades.

As seen in FIG. 8, in the first embodiment, the fluctuation of the static pressure between blades in the range from the motor-side scroll start portion 25 to the scroll finish portion 21, that is, a pressure difference ΔP between the maximum static pressure between blades and the minimum static pressure between blades in the range from the motor-side scroll start portion 25 to the scroll finish portion 21 is smaller than that in the comparative example 1.

Figure 9:
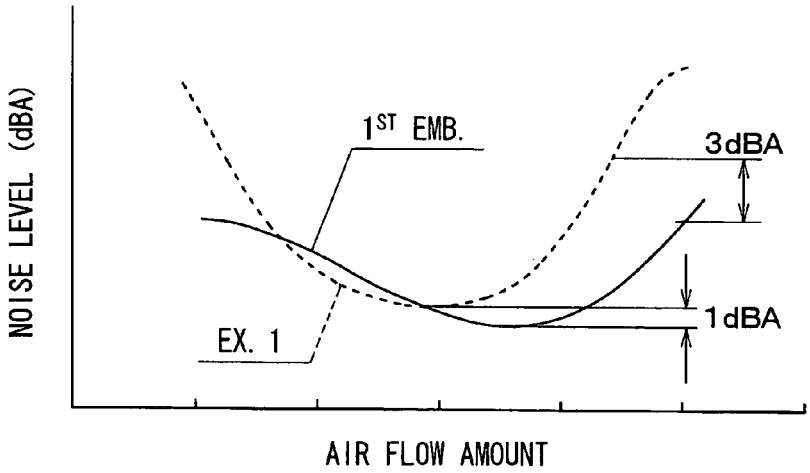
FIG. 9 is a graph showing a specific noise level for the first embodiment.

FIG. 9 is a graph obtained by comparing the measurement result (solid line) of a specific noise level in the first embodiment with the measurement result (broken line) of a specific noise level in the comparative example 1. As shown in FIG. 9, in the first embodiment, both of the minimum specific noise level and the specific noise level at the time of the high air amount can be reduced more than that in the comparative example 1.

In this embodiment, the above test method is compliant with JIS B 8330 and JIS B 8346 and in the test, a fan outer diameter D is 165 mm or less. A definition of a specific noise level is compliant with JIS B 0132.

Second Embodiment

In the first embodiment, the maximum radius R in the motor-side scroll start portion 25 is approximately equal to the outer diameter dimension d of the fan 11, but in the second embodiment, the maximum radius R in the motor-side scroll start portion 25 is approximately equal to 0.71 times the outer diameter dimension d of the fan 11.

Figure 10:
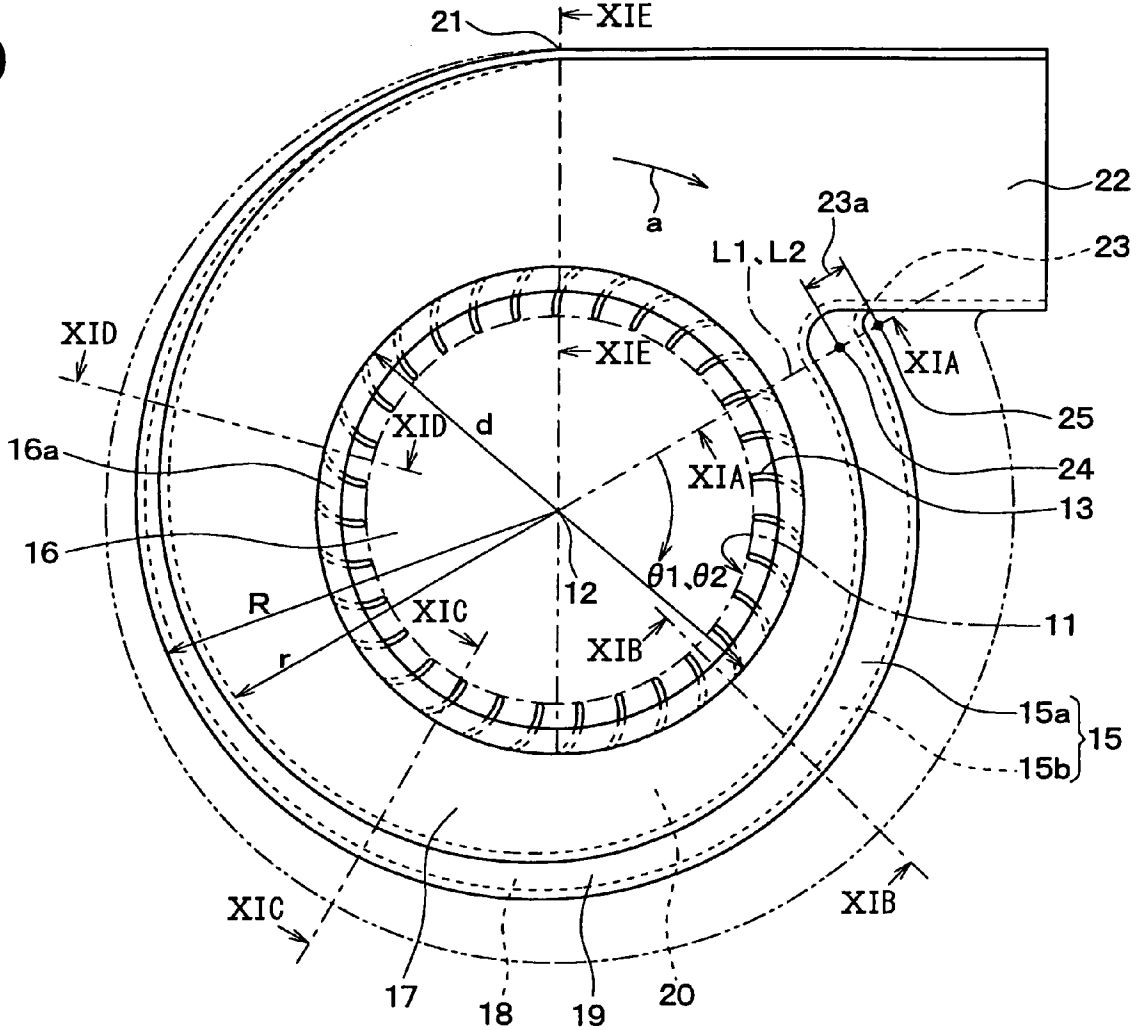
FIG. 10 is a top view of a second embodiment of the blower.

FIG. 10 is a top view of a blower in the second embodiment. In FIG. 10, a chain double-dashed line of the scroll 15 shows a contour of the scroll 15 of the first embodiment.

According to the second embodiment, in the motor-side scroll start portion 25, the cross section configuration of the side wall 19 of the scroll 15 is coupled to the outer edge of the port-side wall portion 17 and is inclined outward (i.e. to the right side in FIG. 11A) to the outer edge of the motor-side wall portion 18. The angle of the side wall 19 changes substantially at the approximate center of the side wall 19 such that the inclination relative to the axis 12 on the bottom end of the side wall 19 is greater than the inclination on the top end of the side wall 19.

The minimum radius r of the scroll radius is adjacent the port-side wall portion 17, and the maximum radius R of the scroll radius is adjacent the motor-side wall portion 18. However, the radii r, R are approximately equal at the scroll finish portion 21.

In the second embodiment, the maximum radius R in the motor-side scroll start portion 25 is smaller than in the first embodiment. More specially, the maximum radius R in the motor-side scroll start portion 25 is approximately 0.71 times the outer diameter dimension d of the fan 11.

As shown in FIGS. 11B to 11E, the cross section configuration of the side wall 19 changes from the motor-side scroll start portion 25 to the motor-side scroll finish portion 21. As shown in FIGS. 11B to 11E, the side wall 19 changes in the side of the motor 14 from an inclined configuration to a configuration that is linear and parallel to the rotation axis 12 from the motor-side scroll start portion 25 to the motor-side scroll finish portion 21. In other words, the cross section configuration of the air passage 20 changes from a configuration that is expanded outwardly adjacent the motor 14 (FIGS. 11A-11D) to a rectangular configuration at the scroll finish portion 21 (FIG. 11E).

The minimum radius r increases to be a logarithmic spiral from the motor-side scroll start portion 25 to the scroll finish portion 21. The maximum radius R also increases to be a logarithmic spiral from the motor-side scroll start portion 25 to the scroll finish portion 21. In the cross section (J-J cross section) in the scroll finish portion 21, the minimum radius r is approximately equal to the maximum radius R.

In one embodiment, the expanding angle of the minimum radius r is 3 to 5 degrees and the expanding angle of the maximum radius R is 2 degrees. In another embodiment, in the second embodiment, the minimum radius r and the maximum radius R increase to be logarithmic spiral, but the minimum radius r and the maximum radius R increase linearly. In another embodiment, the minimum and maximum radii r, R increase sequentially.

In the second embodiment, like the first embodiment, a cross section area S of the air passage 20 increases linearly from the scroll start of the scroll 15 to the side of the scroll finish portion 21. The cross section configuration of the side wall 19 at the cross section (FIG. 11E) in the scroll finish portion 21 is the same as in the first embodiment. Therefore, the cross section area S of the air passage 20 in the scroll finish portion 21 is the same as the corresponding cross section area in the first embodiment.

In addition, the cross section of the side wall 19 shown in FIG. 11B is the same as that of FIG. 11A (cross section in the motor-side scroll start portion 25), which is configured to be bent such that the inclination of the side of the motor 14 is greater than the inclination of the side of the suction port 16. However, the cross section of the side wall 19 on each of the cross sections of FIGS. 11C and 11D is, in contrast, configured to be bent such that the inclination of the side of the suction port 16 is more than the inclination of the side of the motor 14.

In the second embodiment, the maximum radius R in the motor-side scroll start portion 25 is set to 0.71 times the outer diameter dimension of the fan 11, thus reducing the body size in the radial direction of the scroll 15 as compared to that in the first embodiment (chain double-dashed line in FIG. 10), but it can achieve reduction effect of a specific noise level equivalent to that in the first embodiment.

Figure 12:
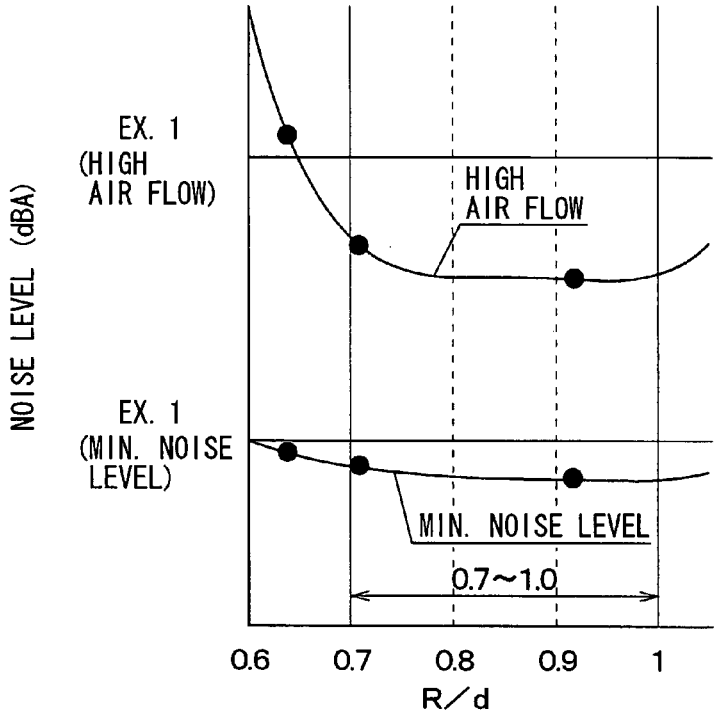
FIG. 12 is a graph showing a relation between a maximum radius at a motor-side scroll start portion and a specific noise level.

FIG. 12 is a graph showing a relation between the maximum radius R in the motor-side scroll start portion 25 and a specific noise level and shows the measurement result of the specific noise level with respect to the blower 10 in the second embodiment and a blower in which the maximum radius R in the motor-side scroll start portion 25 changes relative to the blower in the second embodiment. Each of the blowers used for this measurement is structured such that an expanding angle $\alpha$ of the minimum radius r is 3 to 5 degrees and a cross section area S of the air passage 20 increases linearly.

As shown in FIG. 12, it is found out that the maximum radius R is set to a range from 0.7 times to 1.0 times the outer diameter dimension of the fan 11, making it possible to more drastically reduce both the minimum specific noise level and the specific noise level at the time of the high air amount than in the comparative example 1.

Figure 13:
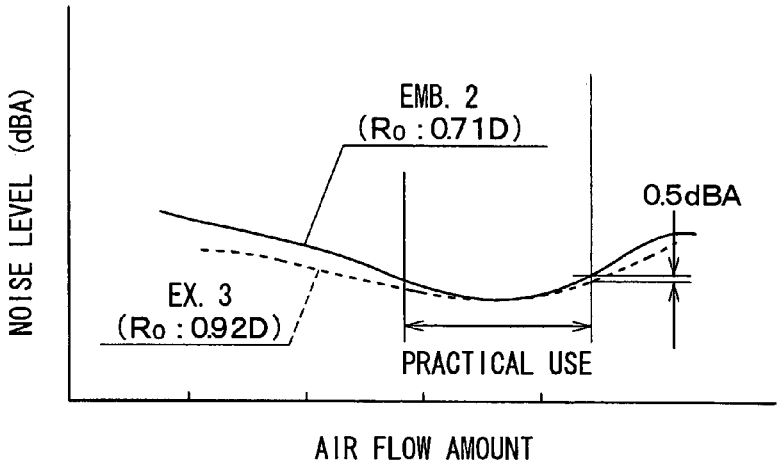
FIG. 13 is a graph showing a specific noise level for the second embodiment.

FIG. 13 is a graph showing the measurement result of a specific noise level (solid line) in the second embodiment. In FIG. 13, the broken line shows the measurement result with respect to a blower (comparative example 3) in which the maximum radius R in the motor-side scroll start portion 25 is changed into 0.92 times the outer diameter dimension d of the fan 11 relative to that in the second embodiment.

As shown in FIG. 13, the specific noise level properties in the second embodiment are substantially the same as the specific noise level in the comparative example 3. That is, even if the maximum radius R in the motor-side scroll start portion 25 is set to 0.71 times the outer diameter dimension d of the fan 11 to reduce the body size in the radial direction of the scroll 15, it is possible to achieve reduction effect of the specific noise level.

Third Embodiment

Figure 14A:
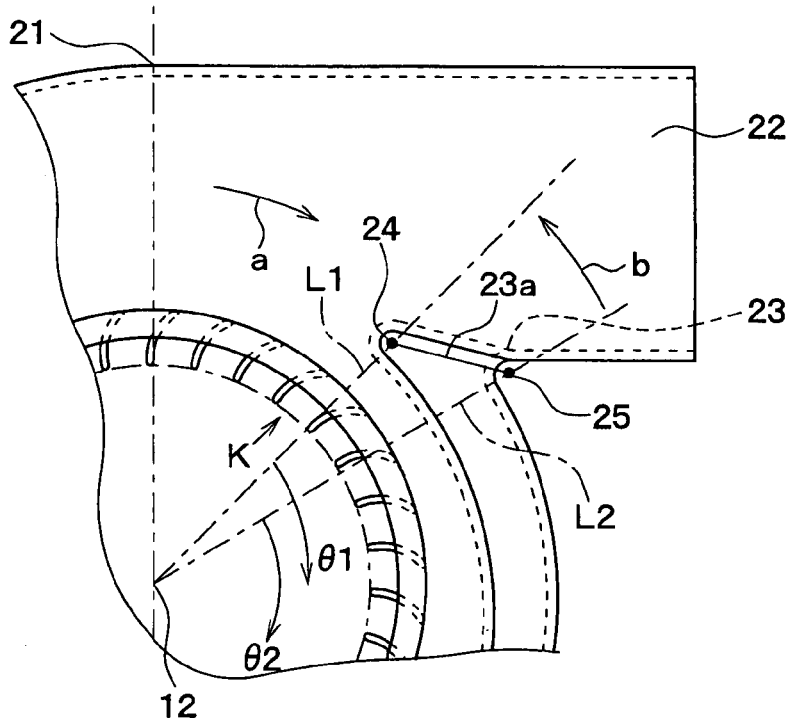
FIG. 14A is a partial top view of a third embodiment of the blower.
Figure 14B:
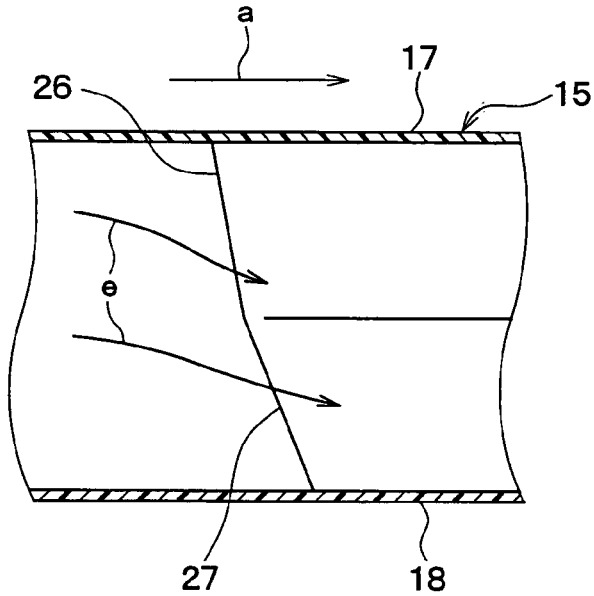
FIG. 14B is a view seen from an arrow K in FIG. 14A.

The third embodiment is provided with a blower in which the nose portion 23 in the second embodiment is changed into a configuration similar to the nose portion in JP-2002-339899A. FIG. 14A is a partial top view of a blower 10 in the third embodiment. FIG. 14B is a detail view taken along the arrow K of FIG. 14A.

In the third embodiment, a wall portion 26 in the side of the suction port 16 adjacent the nose portion 23 is protruded toward the reverse side (arrow b direction in FIG. 14*a*) away from a wall portion 27 at the opposite side (the side of the motor 14) to the suction port 16 adjacent the nose portion 23. That is, the end portion at the reverse side to the fan rotational direction a of the wall portion close to the nose portion 23 is inclined to the fan rotational direction a relative to the rotation axis 12.

Since in the third embodiment, the wall portion 26 in the side of the suction port 16 close to the nose portion 23 is protruded into the reverse side to the fan rotational direction a (the side of the scroll finish portion 21) more than the wall portion 27 at the opposite side (the side of the motor 14) to the suction port 16 close to the nose portion 23, the recirculation flow flowing into the side of the suction port 16 is, as shown in an arrow e of FIG. 14B, guided to the opposite side to the suction port 16 having a high pressure as a whole along the wall portions 26, 27.

Therefore, since the recirculation flow is unlikely to flow reversely between blades 13 to flow in the downstream side with the air blown from the fan 11, it is possible to restrict interference between the recirculation flow and the suction air. As a result, a low-frequency noise caused by the interference between the recirculation flow and the suction air can be reduced, thus reducing the specific noise level further.

It should be noted that the third embodiment is provided with a blower in which the nose portion 23 in the second embodiment is changed into a configuration similar to the nose portion in JP-2002-339899A, but even if the nose portion 23 in the first embodiment is changed into a configuration similar to the nose portion in JP-2002-339899A, it is possible to obtain the similar effect.

Fourth Embodiment

In the third embodiment, the cross section configuration of the air passage 20 changes only in the width direction (the direction perpendicular to the rotation axis 12) from the motor-side scroll start portion 25 to the scroll finish portion 21 and does not change in the height direction (the axial direction of the rotation axis 12). However, in the fourth embodiment, the cross section configuration of the air passage 20 changes not only in the width direction from the motor-side scroll start portion 25 to the scroll finish portion 21 but also changes in the height direction.

Figure 15:
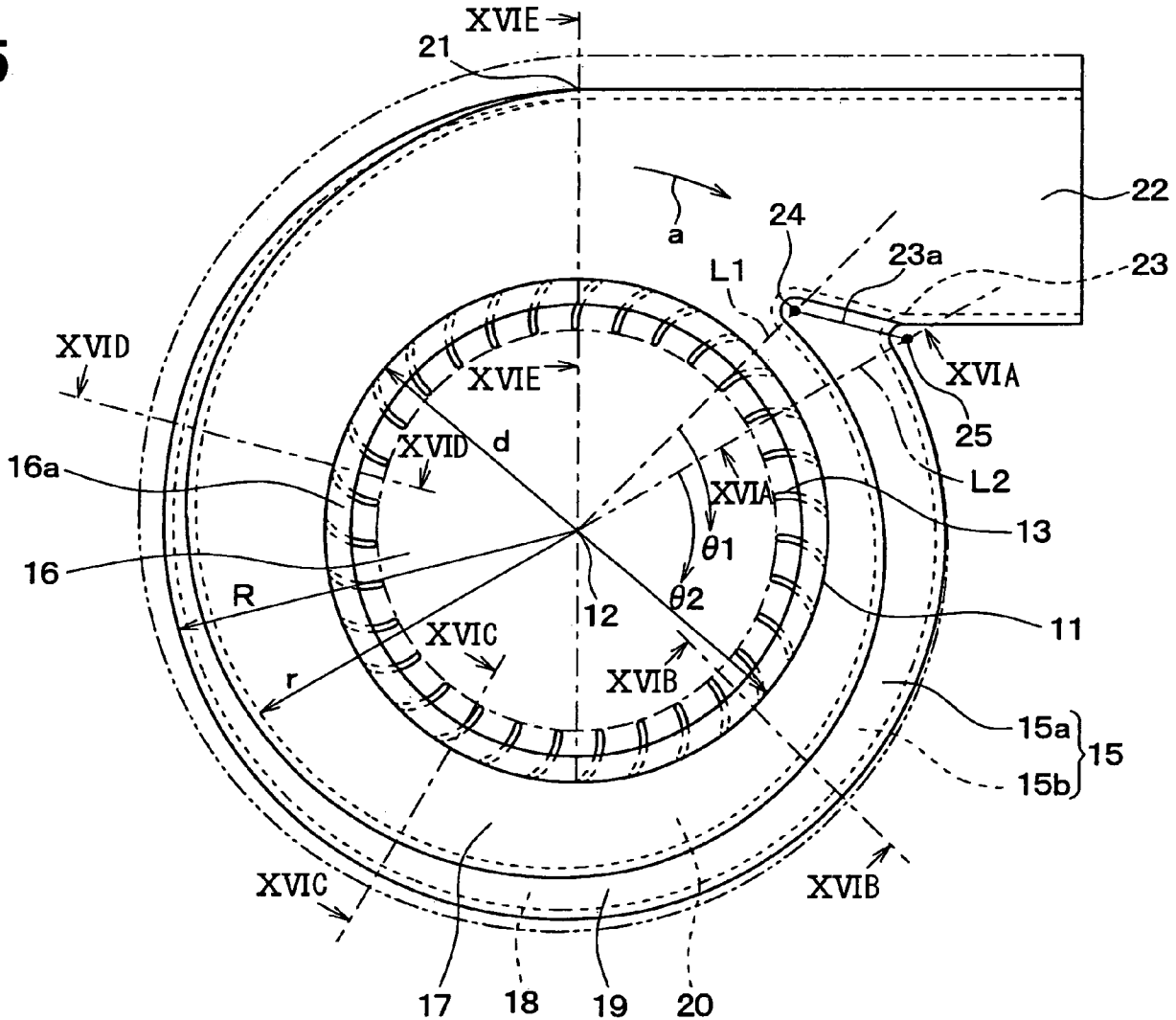
FIG. 15 is a top view of the blower in a fourth embodiment.

FIG. 15 is a top view of a blower in the fourth embodiment. In FIG. 15, a chain double-dashed line of the scroll 15 shows a contour of the scroll 15 in the third embodiment.

Figures 16A, 16B, 16C, 16D, 16E:
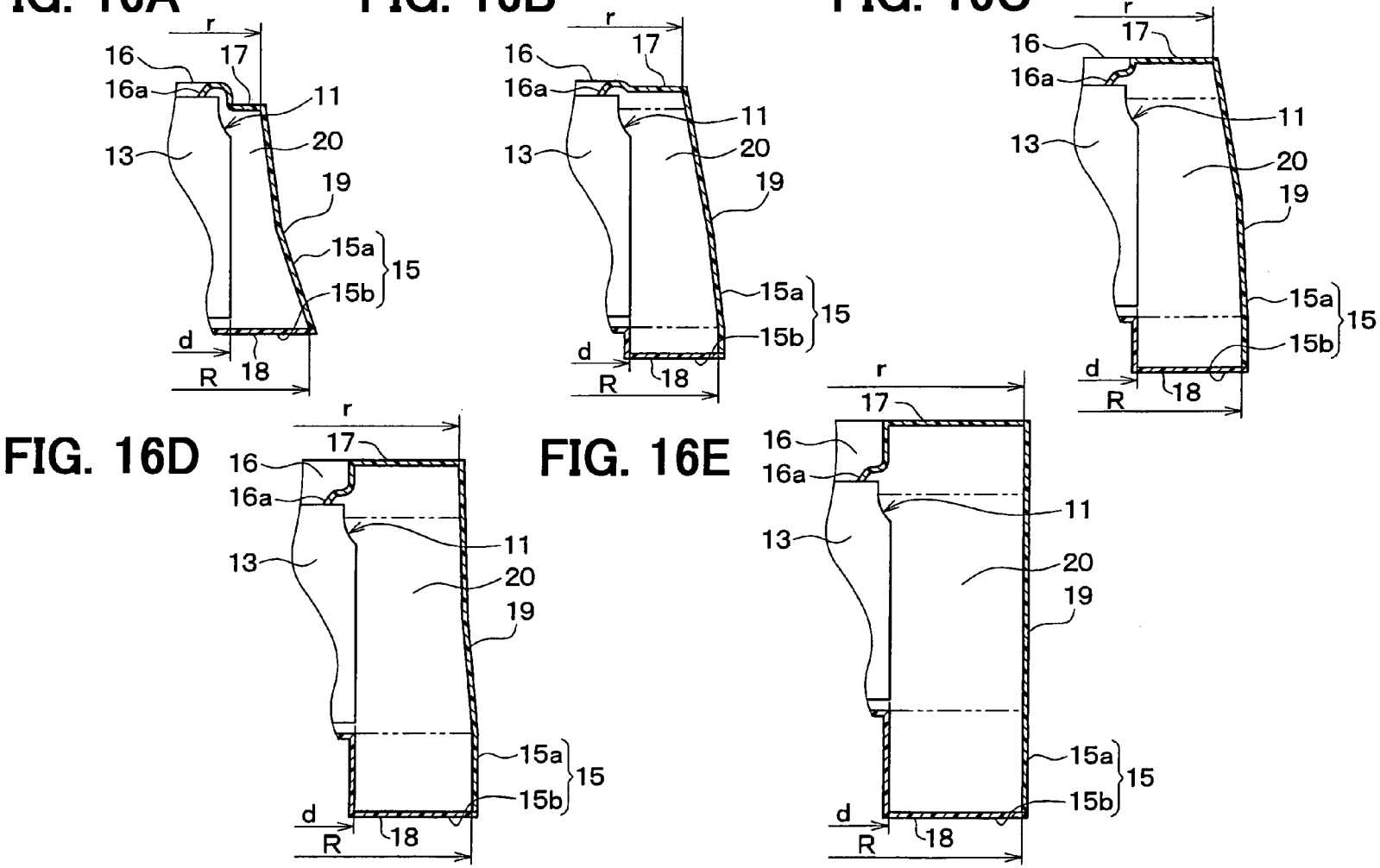
FIG. 16A is a cross section view of the blower taken along line M-M of FIG. 15.
FIG. 16B is a cross section view of the blower taken along line N-N of FIG. 15.
FIG. 16C is a cross section view of the blower taken along the line Q-Q of FIG. 15.
FIG. 16D is a cross section view of the blower taken along line T-T of FIG. 15.
FIG. 16E is a cross section view of the blower taken along line U-U of FIG. 15.

It should be noted that in each of FIGS. 16B to 16E, a chain double-dashed line shows positions of a suction port-side wall portion 17 and a motor-side wall portion 18 in the motor-side scroll start portion 25 (FIG. 16A).

In the fourth embodiment, the cross section configuration of the side wall 19 in the motor-side scroll start portion 25 (FIG. 16A) is substantially the same as in the third embodiment. In addition, in the middle (FIGS. 16B-16D) and in the scroll finish portion 21 (FIG. 16E), both of the minimum radius r and the maximum radius R of the scroll radius are reduced as compared to the third embodiment and the position of the side wall 19 is closer to the rotation axis 12 than in the third embodiment. Therefore, the width of the air passage 20 is smaller than in the third embodiment.

On the other hand, the space between the port-side wall portion 17 and the motor-side wall portion 18 increases from the scroll start portion 25 to the scroll finish portion 21. That is, the height of the air passage (dimension of the air passage in the axial direction (upward and downward directions in FIGS. 16A to 16E) of the rotation axis 12) becomes larger from the motor-side scroll start portion 25 to the scroll finish portion 21.

Thereby, the cross section area S of the air passage 20 can be, similar to the third embodiment, increased linearly from the scroll start of the scroll 15 to the side of the scroll finish portion 21. As a result, the fourth embodiment can achieve reduction effect of the specific noise level equivalent to that in the third embodiment and also further reduce the body size of the scroll 15.

Fifth Embodiment

In the first embodiment, the cross section configuration of the side wall 19 in the scroll 15 at each of the motor-side scroll start portion 25 and the middle (the location between the motor-side scroll start portion 25 and the scroll finish portion 21) is linear at the side of the suction port 16 and also inclined to the radial outer side of the scroll 15 in the side of the motor 14. In addition, in the second embodiment, the cross section configuration of the side wall 19 in the scroll 15 at each of the motor-side scroll start portion 25 and the middle is bent substantially in the center and oblique.

Figure 17:
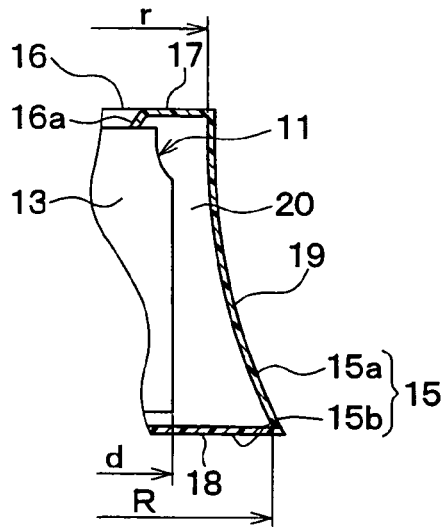
FIG. 17 is a partial cross sectional view of a blower in a fifth embodiment.

However, in the fifth embodiment, as shown in FIG. 17, the entirety of the cross section configuration of the side wall 19 in the scroll 15 at each of the motor-side scroll start portion 25 is curved between the wall portions 17, 18 so as to be inclined to the radial outer side of the scroll 15 from the port-side wall portion 17 to the motor-side wall portion 18.

FIG. 17 is a cross section showing an example of a cross section in each of the motor-side scroll start portion 25 and the middle in the fifth embodiment. Even if the side wall 19 is formed as in the case of the fifth embodiment, the effect similar to the first and second embodiments can be obtained.

Sixth Embodiment

In each of the above embodiments, the cross section configuration of the side wall 19 in the scroll 15 at each of the motor-side scroll start portion 25 and the middle (the portion between the motor-side scroll start portion 25 and the scroll finish portion 21) is formed such that the scroll radius is at the minimum radius r adjacent the port-side wall portion 17. However, in the sixth embodiment, as shown in FIG. 18, the side wall 19 is formed such that the scroll radius is the minimum radius r at portions other than adjacent the port-side wall portion 17.

Figure 18:
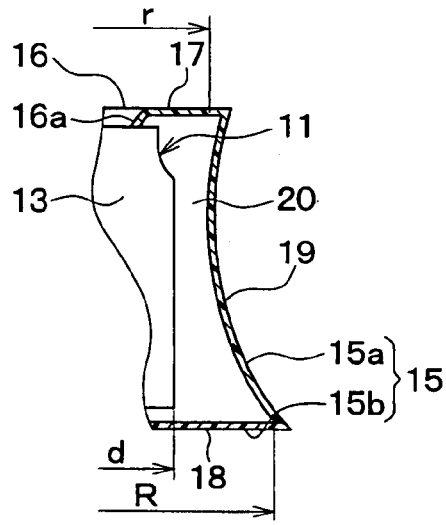
FIG. 18 is a partial cross sectional view of a blower in a sixth embodiment.

For example, FIG. 18 is a cross section showing an example of a cross section in each of the motor-side scroll start portion 25 and the middle in the sixth embodiment. In the sixth embodiment, the cross section configuration of the side wall 19 is made substantially arched to be concaved to the side of the rotation axis 12 (left side in FIG. 18). The minimum radius r of the scroll radius is located on the side wall 19 approximately in the center between the wall portions 17, 18.

The maximum radius R of the scroll radius is located adjacent the motor-side wall portion 18. Even if the side wall 19 is formed as in the case of the sixth embodiment, the effect similar to each of the above embodiments can be obtained.

Seventh Embodiment

Figure 19:
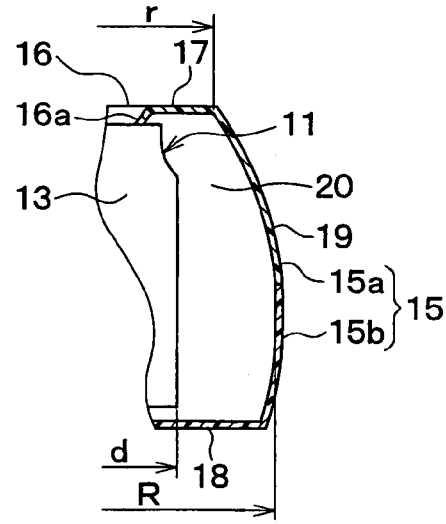
FIG. 19 is a partial cross sectional view of a blower in a seventh embodiment.

Referring now to FIG. 19, a seventh embodiment is illustrated. FIG. 19 represents a cross section of the scroll 15 at the scroll start portion 25 and at the region before the scroll end portion 21. In this embodiment, the cross section of the side wall 19 has convex curvature such that the side wall 19 curves away from the rotation axis 12. As such, the maximum radius R of the scroll radius is found between the port-side wall portion 17 and the motor-side wall portion 18. In the embodiment shown, the maximum radius R is found closer to the motor-side wall portion 18 than the port-side wall portion 17. The minimum radius r is found adjacent the port-side wall portion 17 similar to the above-described embodiments. As such, effects can be obtained that are similar to one or more of the above-described embodiments.

Eighth Embodiment

Figure 20:
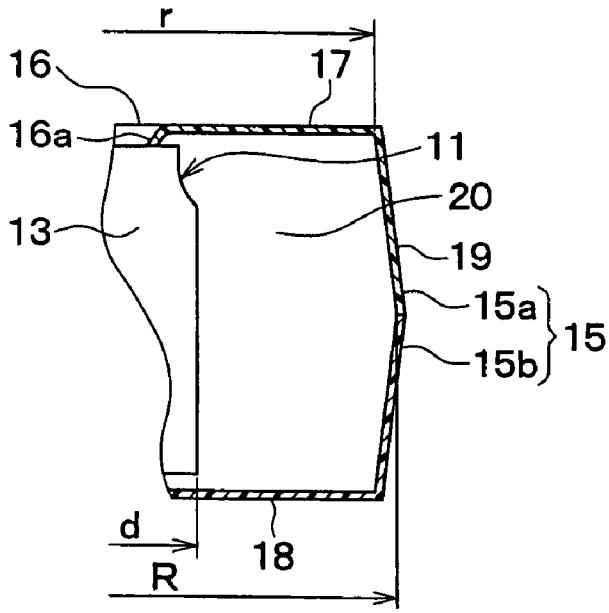
FIG. 20 is a partial cross sectional view of a blower in an eighth embodiment.

Referring now to FIG. 20, an eight embodiment is illustrated. The cross section of the scroll 15 is shown at the scroll end portion 21. In this embodiment, the cross section of the side wall 19 has two planar ends that meet between the port-side wall portion 17 and the motor-side wall portion 18. The two ends of the side wall 19 are inclined outwardly relative to the axis 12. As such, the maximum radius R is located between the port-side wall portion 17 and the motor-side wall portion 18. In the embodiment shown, the maximum radius R is located slightly closer to the motor-side wall portion 18. The minimum radius r is found adjacent the port-side wall portion 17 similar to the above-described embodiments. As such, effects can be obtained that are similar to one or more of the above-described embodiments.

Ninth Embodiment

Figure 21:
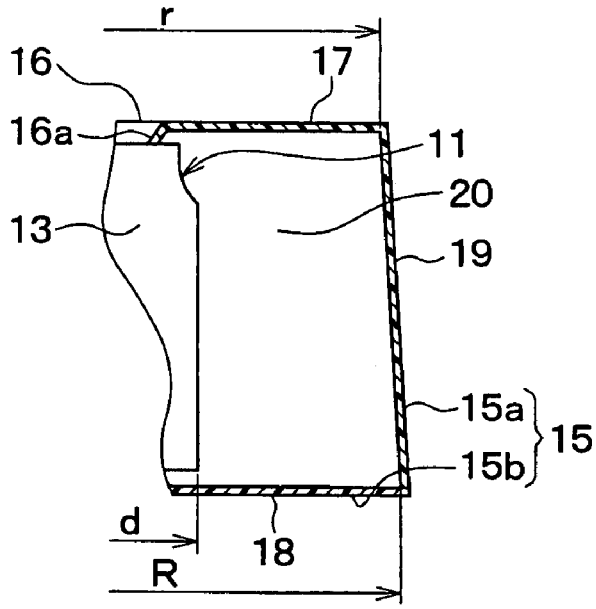
FIG. 21 is a partial cross sectional view of a blower in a ninth embodiment.

Referring now to FIG. 21, a ninth embodiment is illustrated. The cross section of the scroll 15 is shown at the scroll end portion 21. In this embodiment, the cross section of the entire side wall 19 is linear and is inclined relative to the rotation axis 12. The inclination of the side wall 19 is such that the maximum radius R is found adjacent the motor-side wall portion 18, and the minimum radius r is found adjacent the port-side wall portion 17. As such, effects can be obtained that are similar to one or more of the above-described embodiments.

Other Embodiments

In each of the above embodiments, the cross section area S of the air passage 20 is increased linearly from the scroll start of the scroll 15 to the side of the scroll finish portion 21, but, may change to be logarithmic spiral from the scroll start of the scroll 15 toward the side of the scroll finish portion 21 in the same way with the comparative example 1.

In addition, in the first embodiment, the maximum radius R is constant from the motor-side scroll start portion 25 to the scroll finish portion 21 in the first embodiment, and in the second embodiment, the maximum radius R becomes larger sequentially from the motor-side scroll start portion 25 to the scroll finish portion 21. However, the maximum radius R may be made constant in a part between the motor-side scroll start portion 25 and the scroll finish portion 21 and may become larger sequentially in the remaining regions between the motor-side scroll start portion 25 and the scroll finish portion 21.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A centrifugal blower comprising:

a fan including a blade, the fan rotating around a rotation axis; and a scroll casing housing the fan, wherein the scroll casing has a first axial wall portion, a second axial wall portion, and a side wall extending between the first and second axial wall portions, the scroll casing including a suction port in the first axial wall portion, the scroll casing also defining a nose portion and a scroll finish portion, such that the fan sucks a fluid through the suction port and pushes the fluid from the nose portion and out of the scroll casing from the scroll finish portion, wherein:

the scroll casing has scroll radii that are measured transverse to the rotation axis and that vary according to a position from the nose portion to the scroll finish portion, a maximum radius of the scroll radii is closer to the second axial wall portion than the first axial wall portion, a minimum radius of the scroll radii is closer to the first axial wall portion than the second axial wall portion, the side wall has a first side wall portion extending from the first axial wall portion to an intermediate portion of the side wall and a second side wall portion extending from the second axial wall portion to the intermediate portion in the nose portion, the maximum radius is greater than the minimum radius at the nose portion, the second side wall portion extends outward in a radial direction of the scroll casing more than the first side wall portion, and the maximum radius of the scroll radii at the nose portion is in a range of from approximately 0.7 to approximately 1.0 times an outer diameter of the fan.

2. A centrifugal blower according to claim 1, wherein the maximum radius of the scroll radii is constant from the nose portion to the scroll finish portion.

3. A centrifugal blower according to claim 1, wherein the maximum radius of the scroll radii increases from the nose portion to the scroll finish portion.

4. A centrifugal blower according to claim 1, wherein the minimum radius of the scroll radii increases from the nose portion to the scroll finish portion.

5. A centrifugal blower according to claim 4, wherein the minimum radius of the scroll radii is approximately equal to the maximum radius at the scroll finish portion.

6. A centrifugal blower according to claim 5, wherein the fan and the scroll casing cooperate to define an air passage inside the scroll casing, wherein the air passage has a cross sectional area which increases from the nose portion toward the scroll finish portion.

7. A centrifugal blower according to claim 6, wherein the cross sectional area of the air passage increases linearly.

8. A centrifugal blower according to claim 6, wherein the cross sectional area of the air passage increases as a logarithmic spiral.

9. A centrifugal blower according to claim 1, wherein the maximum radius of the scroll radii is adjacent to the second axial wall portion and the minimum radium of the scroll radii is adjacent to the first axial wall portion.

10. A centrifugal blower according to claim 1, wherein a height dimension approximately parallel to the rotation axis changes from the nose portion to the scroll finish portion.

11. A centrifugal blower according to claim 1, wherein a height dimension approximately parallel to the rotation axis increases from the nose portion to the scroll finish portion.

12. A centrifugal blower comprising:

a fan including a blade, the fan rotating around a rotation axis; and a scroll casing housing the fan; wherein the scroll casing has a first axial wall portion, a second axial wall portion and a side wall portion extending between the first and second axial wall portions;

the scroll casing includes a suction port in the first wall portion;

the scroll casing defines a nose portion and a scroll finish portion such that the fan sucks a fluid through the suction port and pushes the fluid from the nose portion and out of the scroll casing from the scroll finish portion;

the scroll casing has a first scroll radius adjacent the first axial wall portion and a second scroll radius adjacent the second axial wall portion;

the second scroll radius is greater than the first scroll radius at the nose portion;

the side wall has a first side wall portion extending from the first axial wall portion to an intermediate portion between the first axial wall portion and the second axial wall portion and a second wall portion extending from the intermediate portion to the second axial wall portion at the nose portion;

a radial distance to the second wall portion at the nose portion continuously increases from the intermediate portion to a position immediately adjacent the second axial wall portion, and the second scroll radius at the nose portion, is in a range of from approximately 0.7 to approximately 1.0 times an outer diameter of the fan.

13. A centrifugal blower according to claim 12, wherein the second scroll radius is constant from the nose portion to the scroll finish portion.

14. A centrifugal blower according to claim 12, wherein the second scroll radius increases from the nose portion to the scroll finish portion.

15. A centrifugal blower according to claim 12, wherein the first scroll radius increases from the nose portion to the scroll finish portion.

16. A centrifugal blower according to claim 15, wherein the first scroll radius is approximately equal to the second scroll radius at the scroll finish portion.

17. A centrifugal blower according to claim 12, wherein a height dimension approximately parallel to the rotation axis changes from the nose portion to the scroll finish portion.

18. A centrifugal blower according to claim 12, wherein a height dimension approximately parallel to the rotation axis increases from the nose portion to the scroll finish portion.

19. The centrifugal blower according to claim 12, wherein a radial distance to the first wall portion at the nose portion is constant from the intermediate portion to a position immediately adjacent the first axial wall portion.

20. The centrifugal blower according to claim 12, wherein a size of the first scroll radius continuously increases from the nose portion to the scroll finish portion such that a difference between the second scroll radius and the first scroll radius continuously decreases from the nose portion to the scroll finish portion.

* * * * *